United States Patent [19]

Nakajima

[11] 4,184,503

[45] Jan. 22, 1980

[54] CRUTCH

[76] Inventor: Kotaro Nakajima, 7, Junikencho, Higashi-ku, Osaka, Japan

[21] Appl. No.: 928,064

[22] Filed: Jul. 26, 1978

[30] Foreign Application Priority Data

Jul. 28, 1977 [JP] Japan ..... 52-101380[U]

[51] Int. Cl.[2] ..... A61H 3/02

[52] U.S. Cl. ..... 135/68; 135/74

[58] Field of Search ..... 135/68, 74; 182/24, 182/163; 16/128, 144, 145, 162

[56] References Cited

U.S. PATENT DOCUMENTS

| | | | |
|---|---|---|---|
| 595,637 | 12/1897 | Kuhnke | 135/68 |
| 790,653 | 5/1905 | Notthoff | 16/144 |
| 1,534,820 | 4/1925 | Walmsley | 135/74 |
| 1,587,383 | 6/1926 | Kennett | 182/24 |
| 1,835,389 | 12/1931 | Ghittino | 16/144 |
| 1,945,460 | 1/1934 | Willis | 135/68 |
| 2,490,380 | 12/1949 | Schweppenheiser | 135/68 |
| 3,811,151 | 5/1974 | Kuemmerlin | 182/163 |

*Primary Examiner*—Reinaldo P. Machado
*Attorney, Agent, or Firm*—Norbert P. Holler

[57] ABSTRACT

A foldable crutch having an upper portion and a lower portion of substantially equal lengths, connecting means adapted for pivotally connecting the adjacent ends of the upper and lower portions, and a locking mechanism adapted to hold the upper and lower portions in the linearly stretched state against the pivotal movement.

9 Claims, 9 Drawing Figures

CRUTCH

BACKGROUND OF THE INVENTION

The present invention relates to a crutch.

For those who are handicapped in their lower limbs, the crutch is a vital and indispensable instrument which they cannot leave even for a moment in their daily lives.

The most serious problem common to all crutched persons resides in the trouble concerning the disposal or storage of the crutch when it is not used, rather than the difficulty in the handling of the same for the walking or the like purposes.

Unfortunately, the modern society is leaning to exclude the crutches in its all aspects. Thus, the crutches are becoming hardly accepted.

SUMMARY OF THE INVENTION

It is therefore a major object of the invention to provide a crutch which can conveniently be folded into a short length when not used.

It is another object of the invention to provide a crutch having an upper and a lower portions which are pivotally secured to each other for a 180° rotation.

It is still another object of the invention to provide a crutch having a mechanism for locking the upper and lower portions against the relative pivotal movement when the crutch is to be presented for use.

It is a further object of the invention to provide a crutch having a locking mechanism which can be handled without difficulty.

These and other objects, as well as advantageous features of the invention, will become more clear from the following description of preferred embodiments taken in conjunction with the accompanying drawings in which:

DESCRIPTION OF THE PREFERRED EMBODIMENTS

Figure 1:
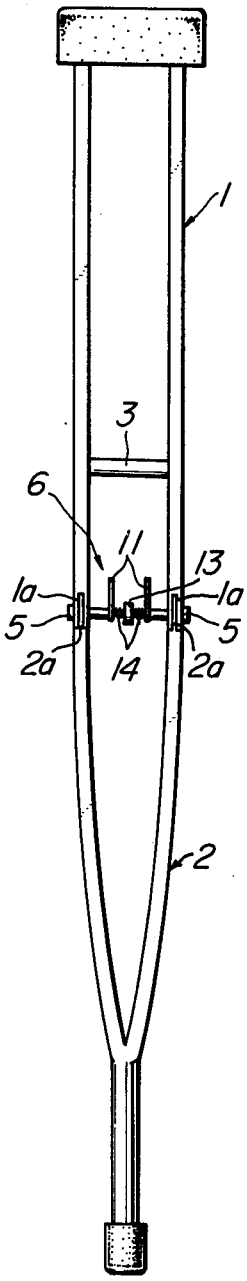
FIG. 1 is a front elevational view of a crutch in accordance with the invention.

Referring to the drawings, a crutch embodying the present invention has an upper portion 1 and a lower portion 2 of substantially equal lengths. The upper portion 1 is provided with a handle or a hand-retaining bar 3. The lower end of the upper portion 1 has a pair of forked or U-shaped portions 1*a*. Each U-shaped portion

1*a* has a groove 1*b* extending in the longitudinal direction of the upper portion 1 and at a right angle to the breadthwise direction of the latter.

On the other hand, the lower portion 2 is provided with a pair of projections 2*a* formed on its upper end. These projections 2*a* are received by the grooves 1*b* of corresponding U-shaped portions 1*a*.

Figure 7:
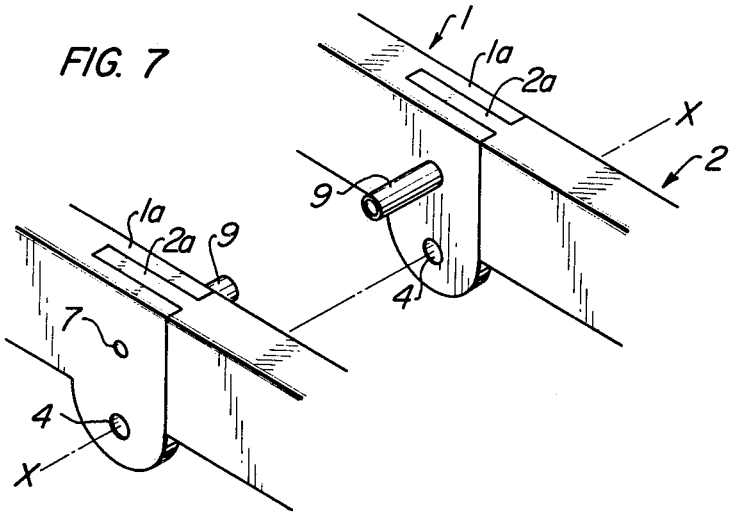
FIG. 7 is an enlarged perspective view of the connecting portion with the constituents of the locking mechanism removed.
Figure 8:
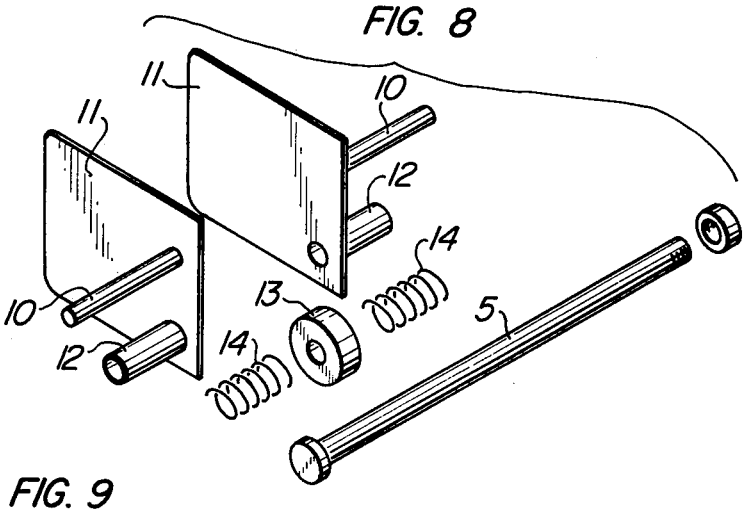
FIG. 8 is an exploded perspective view of the locking mechanism, showing the constituents of the same.
Figure 9:
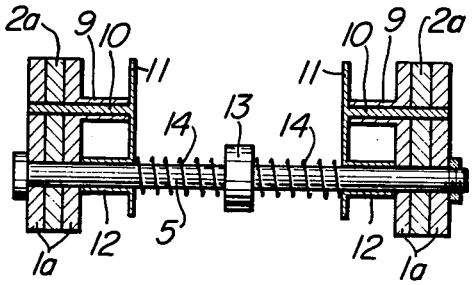
FIG. 9 is a sectional view taken along the line IX—IX of FIG. 5.

As will be seen most clearly from FIG. 7, the U-shaped portion 1*a* and the projection 2 have lateral extensions which are shown, in FIG. 7, to project downwardly from the upper and lower portions 1, 2. Mutually aligned through bores 4 are formed in these lateral extensions of the U-shaped portions 1*a* and the projections 2*a*.

The common axis X—X of the through bores 4 extends in the breadthwise direction of the crutch and at a right angle to the longitudinal axis of the crutch.

Figure 2:
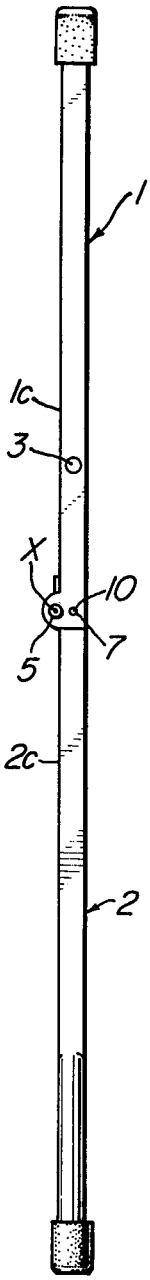
FIG. 2 is a side elevational view of the crutch as shown in FIG. 1.

As will be seen from FIG. 2, the center X of the through bore 4 is slightly deviated outwardly from the side edges 1*c*, 2*c* of the upper and lower portions 1, 2 of the crutch.

Figure 3:
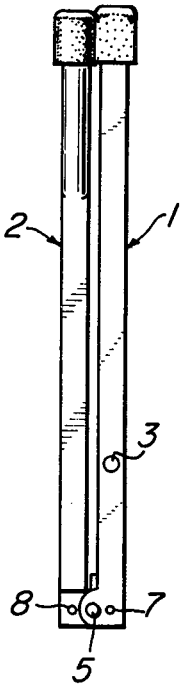
FIG. 3 is a side elevational view of the crutch in the folded state.
Figure 4:
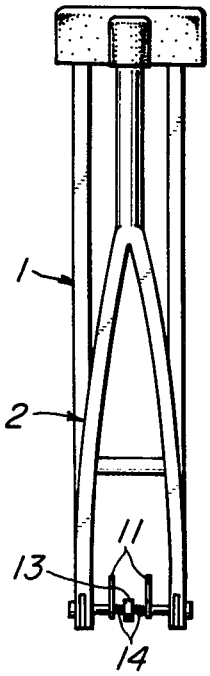
FIG. 4 is a front elevational view of the crutch in the folded state.

The upper portion 1 and the lower portion 2 are pivotally connected to each other through a rod 5 which is inserted into the through bores 4. Thus, the lower portion 2 can be swung by 180° around the axis of the rod 5, from the folded position as shown in FIGS. 3, 4 in which it extends in parallel with the upper portion 1 to the stretched position as shown in FIGS. 1, 2 in which it is linearly extended from the upper portion 1.

The arrangement is such that the ends 1*d* of each U-shaped portion 1*a* abut shoulders 2*d* formed at both sides of each projection 2*a*, when the lower portion 2 is rotated by 180° into the stretched position, thereby to prevent the lower portion 2 from being further rotated beyond 180°. It is also possible to prevent the rotation of the lower portion 2 beyond 180° by the abutment of the end surface of each projection 2*a* and the bottom surface of the corresponding groove 1*b*.

A locking mechanism generally designated at a reference numeral 6 includes a locking bore 7 formed in the U-shaped portion 1*a* and another locking bore 8 formed in the projection 2*a*. These locking bores 7, 8 are so arranged that they are brought into alignment with each other when the lower portion 2 is in the stretched position.

Guide pipes 9 are fixed to the opposing surfaces of two U-shaped portions 1*a*, 1*a*, in axial alignment with respective locking bores 7. Each guide pipe 9 slidably holds a locking pin 10. Each locking pin 10 is fixed to an operation plate 11. These operation plates 11 are fixed to respective pipes 12 which are slidable along the rod 5. A collar 13 is fixed by suitable means to the center of the rod 5. A coiled spring 14 is disposed on each side of the collar 13. These coiled springs 14 are adapted to bias respective operation plates toward the corresponding U-shaped portions 1*a*, so as to drive the locking pins into the locking bores 7, 8. Two operation plates 11, 11 are spaced apart from each other by such a distance that these operation plates can easily be brought together by fingers of single hand.

Figure 5:
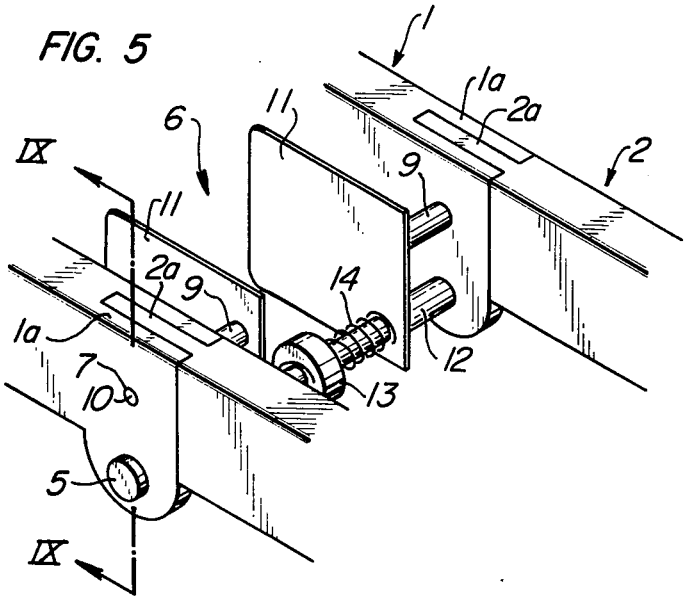
FIG. 5 is an enlarged perspective view of the crutch in the locked state, specifically showing the connecting portion of the upper and lower parts of the crutch.

In use, the lower portion 2 of the crutch in accordance with the invention is locked at the stretched position as shown in FIGS. 1 and 2, with the locking pins 10 received by corresponding locking bores as shown in FIG. 5.

Figure 6:
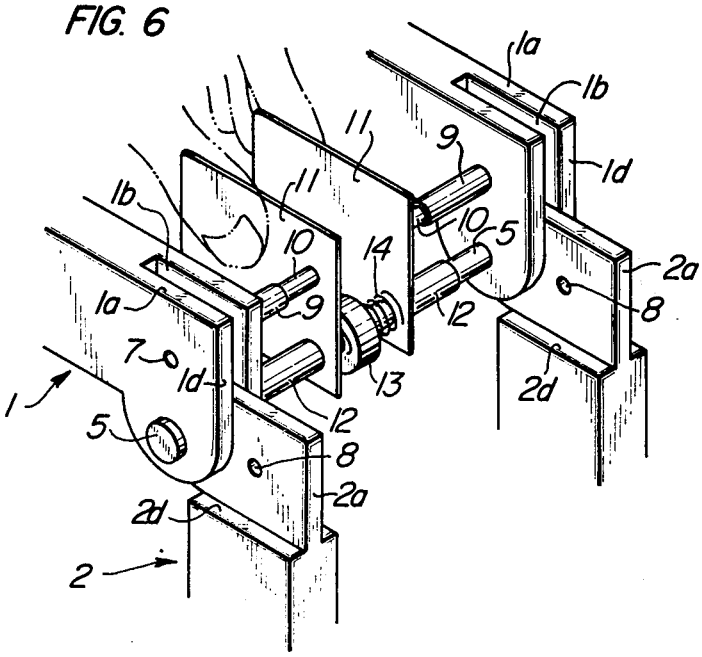
FIG. 6 is an enlarged perspective view of the crutch in the unlocked and slightly folded state, specifically showing the same portion as that shown in FIG. 5.

For folding the crutch, two operation plates 11, 11 are brought together by fingers as shown in FIG. 6, so that the locking pins 10, 10 may be disengaged at least from the locking bores 8, 8. Then, the lower portion 2 is simply pivoted with respect to the upper portion 1 to the folded position as shown in FIGS. 3, 4.

Since the length of the crutch is reduced to half by the folding, the crutch in the folded state can be handled quite easily and can conveniently be stored even in an extremely limited space.

Further, the folded crutch can support itself and, therefore, can conveniently be used as a temporary stool, by flattening the lower end of the crutch in the folded state as shown in FIG. 3.

Various modifications in structure and/or function may be made to the disclosed embodiments by one skilled in the art without departing from the scope of the invention as defined by the claims.

What is claimed is:

1. A crutch comprising an elongated upper portion and an elongated lower portion; connecting means for pivotally connecting the adjacent ends of the upper and and lower portions to each other about a pivot axis extending substantially in the breadth-wise direction of the crutch and substantially at a right angle to the longitudinal axis of the crutch, the connecting means including a pair of spaced U-shaped portions formed at the end of either one of the upper and lower portions, a pair of spaced projections formed at the end of the other of the upper and lower portions, each of said projections being adapted to be received within a groove defined by legs of the corresponding U-shaped portion, through bores formed in mutual alignment in the U-shaped portions and the projections, and a rod extending through the through bores so that U-shaped portions and the projections are pivotally connected to each other; and locking means for locking the upper and lower portions against pivotal movement, in such a stretched state that the lower portion is linearly extended from the upper portions, the locking means including a pair of operating plates slidably held on the rod between the U-shaped portions, locking pins parallel to the rod and rigidly secured on the operating plates, respectively, first locking bore formed in each of the U-shaped portions parallel to the rod, and second locking bore formed in each of the projections, the first and second locking bores being adapted to register and to receive one of the locking pins when the upper and lower portions are aligned with each other.

2. A crutch as claimed in claim 1, wherein said upper and lower portions have substantially equal lengths.

3. A crutch as claimed in claim 1 further comprising a stop means adapted to prevent said upper portion from being rotated beyond 180° around said pivot axis in relation to said lower portion.

4. A crutch as claimed in claim 1, wherein said locking means further comprises a pair of guides secured on the opposing surfaces of said pair of said U-shaped portions in axial alignment with said locking bores to guide said locking pins, respectively.

5. A crutch as claimed in claim 4, wherein said locking means further comprises biasing means for biasing said operation plates away from each other to insert said locking pins into their associated locking bores.

6. A crutch as claimed in claim 4, wherein said biasing means includes a collar secured on said rod between said operating plates and a pair of coiled springs each disposed between said collar and one of said operating plates.

7. A crutch as claimed in anyone of claim 4 or claim 5 or claim 6 or claim 1 further comprising stop means for preventing the upper portion from rotating beyond a position in which the upper portion is in alignment with the lower portion.

8. A crutch as claimed in claim 7, wherein the stop means comprises a pair of shoulders formed on both sides of each of said projections and a pair of end surfaces of each of said U-shaped portions, said end surfaces being adapted to contact with said shoulders when said upper and lower portions are aligned with each other.

9. A crutch as claimed in claim 7, wherein said stop means comprises a bottom surface of said groove of each of said U-shaped portions and an end surface of each of said projections, said end surface being adapted to contact with said bottom surface when said upper and lower portions are aligned with each other.

* * * * *